United States Patent [19]

King

[11] 4,315,717

[45] Feb. 16, 1982

[54] EVACUATION SYSTEM WITH PRECONDENSER

[75] Inventor: Stephen J. King, Clearwater, Fla.

[73] Assignee: The Nash Engineering Company, Norwalk, Conn.

[21] Appl. No.: 95,760

[22] Filed: Nov. 19, 1979

[51] Int. Cl.[3] ..... F04C 19/00

[52] U.S. Cl. ..... 417/69; 417/87; 417/250

[58] Field of Search ..... 417/68, 69, 87, 244, 417/250, 153

[56] References Cited

U.S. PATENT DOCUMENTS 1,991,548 2/1935 DeMotte ..... 417/68
3,315,879 4/1967 Jennings ..... 417/69 X
3,481,529 12/1969 Mugele ..... 417/69 X
3,575,532 4/1971 Mugele et al. ..... 417/69

*Primary Examiner*—Carlton R. Croyle
*Assistant Examiner*—Edward Look
*Attorney, Agent, or Firm*—Robert R. Jackson; John A. Howson

[57] ABSTRACT

A high capacity evacuation system employing a precondenser receiving process fluids having liquid and gaseous phases, a first stage jet diffuser and a second stage liquid ring pump for handling the process fluids and in which system the motivating fluid for the jet diffuser is air; seal liquid is continuously fed from a seal liquid source outside the system; and the piping between the components of the system is unobstructed.

10 Claims, 3 Drawing Figures

EVACUATION SYSTEM WITH PRECONDENSER

BACKGROUND OF THE INVENTION

The present invention is derived as an improvement in high capacity evacuation systems employing a first stage jet diffuser and a second stage liquid ring pump for handling fluids having liquid and gaseous phases. It has general application in such systems although it initially arose in consideration of such systems which are used to evacuate corrosive fluids from phosphoric acid evaporators and thus has specific application to evacuation systems which handle corrosive fluids.

In U.S. Pat. No. 3,315,879 there is disclosed an evacuation system capable of handling, at high capacity, fluids having liquid and gaseous phases. In that system, the liquid ring pump forms a second stage to a first stage jet diffuser. A condenser is interposed between the diffuser and liquid ring pump and separates condensable and noncondensable components of an air mixture evacuated from a condenser of a power plant. The condenser or separating means separates out the liquid and directs it to the inlet portion of the liquid ring pump so that only noncondensable fluid components reach the inlet of the jet diffuser. The patented system requires a liquid trap downstream of the separating means and upstream of the suction portion of the liquid ring pump to prevent back flow of separated liquid to the inlet portion of the jet diffuser. The system also requires valving within the system to accommodate hogging and changeover from hogging to the maintenance of high vacuum and further valving is required for recirculation of seal liquid.

Furthermore, the patented system is a "closed" system in which the separated, noncondensable fluid is recirculated to be used as the motivating fluid for the jet diffuser. Also, the closed system provides for recirculating seal liquid. Such a closed system, besides requiring the valving as noted above, also requires cooling apparatus for cooling recirculated seal liquid. Inasmuch as the motivating fluid for the jet diffuser comprises the processed fluid in such a system, corrosive fumes would be recirculated in applications of such a system to corrosive fume producing evacuations.

THE INVENTION

The present invention comtemplates achieving sufficient condensing of the processed fluids to optimize the selection of the air jet and vacuum pump equipment; that is the sizes thereof, without incorporating expensive liquid trap elements and valving. It proposes to eliminate recirculating of seal liquid, thereby decreasing the power requirements of the system. Along with eliminating the valving, the invention contemplates the consequent rendering of the system automatic.

It is an object of the invention to provide such a system which does not recirculate concentrated corrosive components of the corrosive fluids; i.e. to dilute processed fluids in chemical applications to thereby reduce corrosion in the system.

The above objects of the invention are accomplished by providing a high capacity evacuation system for handling fluids having liquid and gaseous phases and comprising a liquid ring pump arranged as a second stage to a first stage jet diffuser and in which motivating fluid for the jet diffuser is air and in which seal liquid is continuously fed to the system from a seal liquid source outside the system. The products of condensation in the system are also used for seal liquid. The same source of seal liquid is also used as precondenser water for providing sprays in the system to assist in the condensing process. In this last respect, precondenser water in the form of spray or processed fluid is delivered to a condenser which with the help of the cooling effect of the precondenser water, sprayed or coiled, separates the condensable and noncondensable elements; the condensable elements along with the sprayed precondenser water being delivered to the seal system of the liquid ring pump and through a position upstream of the pump to the suction end thereof as a spray. Both the seal fluid system and the suction position spray are also fed with liquid from the separate source. In the case of a condenser with cooling water circulated in coils or tubes, the cooling water is delivered to the pump as seal water and spray upstream of the suction end of the pump and the condensed elements may be separated out. This is particularly advantageous when the processed fluids are contaminated or corrosive.

Cooling of the liquid for precondensing and for sealing is contemplated with the use of the cooling process engendered by and within the air jet. Similarly, cooling of the precondenser and seal fluid as well as the motive air can be provided upstream of the air jet.

THE DRAWINGS

The invention will better be understood through the reading of the following specification in conjunction with the drawings in which.

In the figures, like parts are designated by the same reference numerals.

Figure 1:
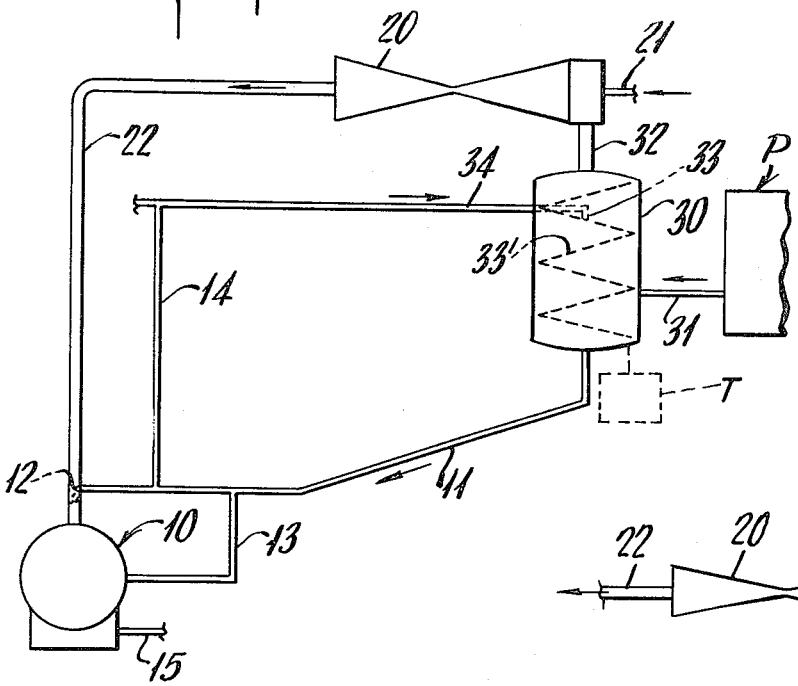
FIG. 1 is a schematic view of an evacuation system embodying the invention.

The evacuation system of FIG. 1 includes a liquid ring pump 10, a jet diffuser 20 and a condenser 30. Processed fluids having liquid and gaseous phases are drawn to the condenser 30 via conduit 31 which may in one application of the invention extend from the condenser of a phosphoric acid evaporator P. The noncondensable, i.e., gaseous fluids exit through the outlet at the upper portion of the condenser 30 through conduit 32 which supplies the inlet to the jet diffuser 20. The jet diffuser 20 is supplied with motive fluid, in this instance air, through conduit 21. The air as well as the gas from the process is pulled through conduit 22 from the outlet of the jet diffuser by the vacuum action of the pump 10.

In a preferred embodiment of the invention, the condenser 30 is of the barometric type in which there is direct contact between the process fluids and condenser liquid. Separation of the gas from the liquid in the condenser 30 is thus enhanced by the introduction into the condenser 30 of condenser liquid, in the instance shown, tap water, in the form of a spray from spray nozzle 33 which is fed by conduit 34. Alternatively, a shell and tube construction for the condenser may be used in which cooling water from tap conduit 34 is circulated through a coil 33' shown in dash lines in FIG. 1 in which case, the cooling water would be fed via conduit 11 to the pump 10 as seal water via conduit 13 and to spray nozzle 12 at the suction end of the pump. With such a construction, the condensed liquid from process P could be delivered to trap T, thus eliminating corrosive condensate from the system when the processed fluids contain corrosive condensables.

The water from spray nozzle 33 along with the condensed liquid from the condenser is fed, via conduit 11 and the vapors in conduit 22 are fed through conduit 22 to just upstream of the suction end of the pump 10. Conduit 11 may terminate within conduit 22 in a spray nozzle 12 shown diagramatically in dash lines. Conduit 13 feeds cool water and process condensate from conduit 11 to the pump 10 as seal liquid for the pump.

In the system disclosed in FIG. 1, tap water is also diverted via conduit 14 from the condenser water line 34 to conduit 11 to feed spray nozzle 12, the water from which finds its way to the liquid ring in the pump 10 and the excess of which is added to the seal liquid/water. With the addition of the cold water from tap, the spray nozzle water is thus the coldest available, as source fluid and permits additional condensing in the pump.

The cool spray from spray nozzle 12, of course, acts to enhance condensation of the processed gas and air vapor mixture from conduit 22 and jet diffuser 20.

The discharge 15 of the pump 10 may be connected to a separator where the spent-excess liquid is drained. Such liquid may be cooled and recirculated back into the system, but the invention preferably contemplates the feeding of fresh, cold seal fluid continuously in any event.

Figure 2:
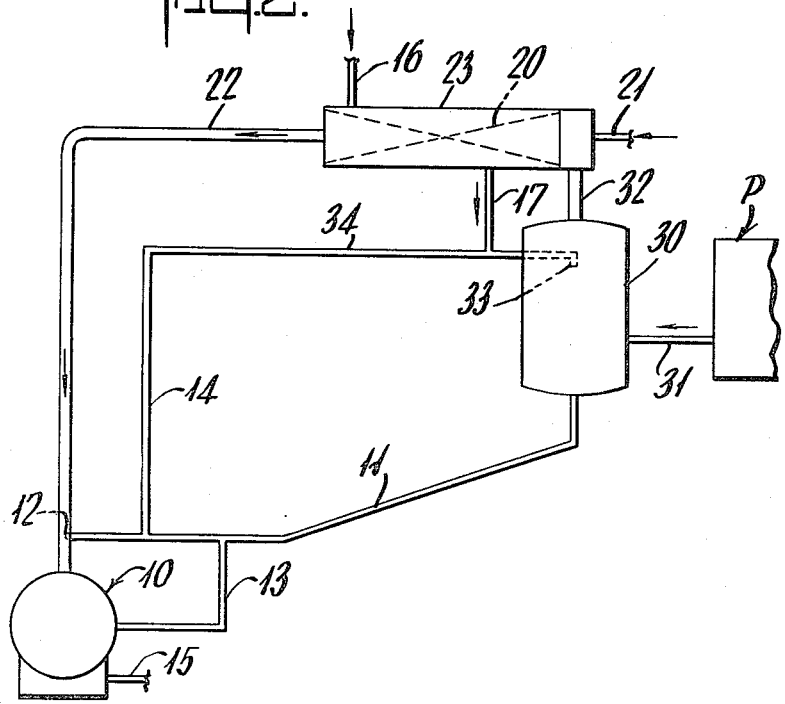
FIG. 2 is a schematic view of another embodiment of the invention.

In FIG. 2, the same basic system is shown, the difference being in the provision of a jacket 23 about the jet diffuser 20. Precondenser water is fed to the jacket via conduit 16 where it is cooled by contact with the heat transfer surfaces of the jet diffuser which have been cooled by the phenomenom resulting from the motivating air in the jet reaching sonic velocities in the throat area of the jet. The thusly cooled tap water is drawn via conduit 17 through conduit 34 and to nozzle 33. Cooling of the condenser water, of course, optimizes the condensing in the condenser and as seal water.

Figure 3:
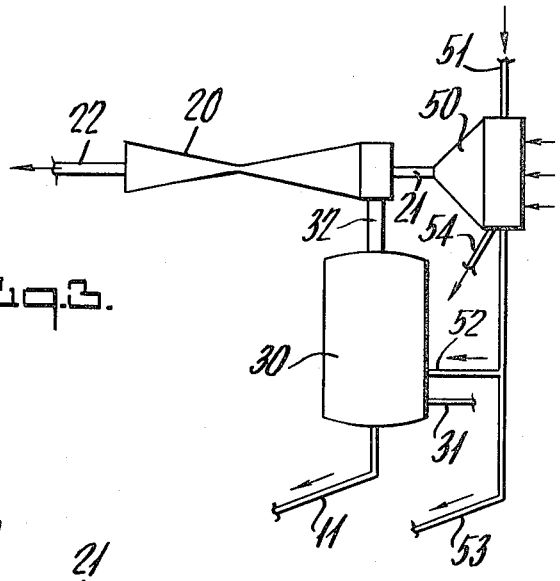
FIG. 3 is a schematic view of yet another embodiment of the invention.

Alternatively, a heat exchanger such an exchanger 50 shown in FIG. 3, such as an air cooled radiator or the like may be provided upstream of the jet diffuser for cooling the air delivered to the diffuser and also for cooling the tap water which may be fed to the cooler 50 via conduit 51 and led from the cooler 50 to the condenser 30 and to the spray nozzle 12 through conduit 11, as well as to the nozzle 12 via conduit 53. Condensate from the cooler 50 may also be brought into the system via conduit 54.

Again, the idea is to put the coolest fluid possible into the condenser and the spray nozzles to achieve maximum condensing.

In this last embodiment, if air is warm, water temperature will rise but the removal of condenser moisture out of the air will reduce freezing in the jet diffuser. However, evaporative cooling will tend to keep the water cool. If the air is cold, water temperature will decrease, adding to condensing activity.

The choice of systems and the intention of uses are the deciding factors in the mode of operation to take advantage of operating conditions prevailing then and about the system.

What is claimed is:

1. In a system for evacuating process fluid having liquid and gaseous phases and in which there is provided a liquid ring pump having a seal liquid inlet and suction and discharge portions and forming a second stage of the system, a jet diffuser having inlet and outlet portions and forming a first stage of the system, the outlet portion of the jet diffuser communicating with the suction portion of the liquid ring pump via a diffuser-to-pump conduit, a supply conduit communicating with and feeding motivating fluid to the inlet portion of the jet diffuser, separating means for separating out and condensing the liquid phase of the process fluid being evacuated and for separating out the gaseous phase of the process fluid being evacuated, said separating means having a process fluid inlet, a gaseous phase outlet and a liquid phase outlet, the gaseous phase outlet communicating with the inlet of the jet diffuser via a separator-to-diffuser conduit, the liquid phase outlet of the separator communicating with the suction portion of the liquid ring pump via a separator-to-pump conduit; the improvement in which the supply conduit communicating with and feeding motivating fluid to the inlet of the jet diffuser communicates with and supplies atmospheric air to the diffuser; the improvement further comprising a liquid supply external to the system communicating with the liquid ring pump seal liquid inlet and delivering cooling liquid to the separator via a liquid supply-to-separator conduit which terminates within the separator in a spray nozzle; and wherein the separator-to-pump conduit terminates at the suction portion of the pump in a spray nozzle.

2. In the system of claim 1 wherein there is provided a conduit between said separator-to-pump conduit and said seal liquid inlet.

3. In the system of claim 1 wherein the liquid supply also delivers cooling liquid to the suction portion of the pump via a liquid supply-to-pump conduit.

4. In the system of claim 1 wherein the process fluid is evacuated from the condenser of a phosphoric acid evaporator and said air supply conduit and said jet diffuser constitute means for diluting acid fumes with motive air.

5. In the system of claim 1 wherein the process fluid is evacuated from the condenser of a phosphoric acid evaporator and said separator and said liquid supply constitute means for diluting condensed corrosive components with liquid.

6. In the system of claim 1 wherein the process fluid is corrosive and said air supply conduit and said jet diffuser constitutes means for diluting corrosive vapor with motive air.

7. In the system of claim 1 wherein the process fluid is corrosive and said separator and said liquid supply constitute means for diluting condensed corrosive components with liquid.

8. In a system for evacuating process fluid having liquid and gaseous phases and in which there is provided a liquid ring pump having a seal liquid inlet and suction and discharge portions and forming a second stage of the system, a jet diffuser having inlet and outlet portions and forming a first stage of the system, the outlet portion of the jet diffuser communicating with the suction portion of the liquid ring pump via a diffuser-to-pump conduit, a supply conduit communicating with and feeding motivating fluid to the inlet portion of the jet diffuser, separating means for separating out and condensing the liquid phase of the process fluid being evacuated and for separating out the gaseous phase of the process fluid being evacuated, said separating means having a process fluid inlet, a gaseous phase outlet and a liquid phase outlet, the gaseous phase outlet communicating with the inlet of the jet diffuser via a separator-to-diffuser conduit, the liquid phase outlet of the separator communicating with the suction portion of the liquid ring pump via a separator-to-pump conduit; the improvement in which the supply conduit communicating with and feeding motivating fluid to the inlet of the jet diffuser communicates with and suplies atmospheric air to the diffuser; the improvement further comprising a liquid supply external to the system communicating with the liquid ring pump seal liquid inlet and delivering cooling liquid to the separator via a liquid supply-to-separator conduit, and wherein there are provided means for jacketing the jet diffuser means and said liquid supply-to-separator conduit passes through said jacketing means for cooling the liquid.

9. In a system for evacuating process fluid having liquid and gaseous phases and in which there is provided a liquid ring pump having a seal liquid inlet and suction and discharge portions and forming a second stage of the system, a jet diffuser having inlet and outlet portions and forming a first stage of the system, the outlet portion of the jet diffuser communicating with the suction portion of the liquid ring pump via a diffuser-to-pump conduit, a supply conduit communicating with and feeding motivating fluid to the inlet portion of the jet diffuser, separating means for separating out and condensing the liquid phase of the process fluid being evacuated and for separating out the gaseous phase of the process fluid being evacuated, said separating means having a process fluid inlet, a gaseous phase outlet and a liquid phase outlet, the gaseous phase outlet communicating with the inlet of the jet diffuser via a separator-to-diffuser conduit, the liquid phase outlet of the separator communicating with the suction portion of the liquid ring pump via a separator-to-pump conduit; the improvement in which the supply conduit communicating with and feeding motivating fluid to the inlet of the jet diffuser communicates with and supplies atmospheric air to the diffuser; the improvement further comprising a liquid supply external to the system communicating with the liquid ring pump seal liquid inlet, and wherein there are provided means for cooling fluid communicating with said air supply conduit means for cooling the air.

10. In the system of claim 9 wherein the liquid supply delivers cooling liquid to the system through said fluid cooling means whereby said cooling liquid is cooled.

* * * * *